US006866438B2

(12) United States Patent
Bauer et al.

(10) Patent No.: US 6,866,438 B2
(45) Date of Patent: Mar. 15, 2005

(54) CRAYON

(75) Inventors: Reinhard Bauer, Rosstal (DE); Ulrich Griebel, Altdorf (DE); Georg Roeder, Schwabach (DE)

(73) Assignee: Schwan-STABILO Cosmetics GmbH & Co. KG, Heroldsberg (DE)

( * ) Notice: Subject to any disclaimer, the term of this patent is extended or adjusted under 35 U.S.C. 154(b) by 0 days.

(21) Appl. No.: 10/169,659

(22) PCT Filed: Sep. 24, 2001

(86) PCT No.: PCT/EP01/11029

§ 371 (c)(1),
(2), (4) Date: Oct. 15, 2002

(87) PCT Pub. No.: WO02/30680

PCT Pub. Date: Apr. 18, 2002

(65) Prior Publication Data

US 2003/0129014 A1 Jul. 10, 2003

(30) Foreign Application Priority Data

Oct. 5, 2000 (DE) ..... 200 17 141 U

(51) Int. Cl.[7] ..... B43K 5/12; B43K 21/08

(52) U.S. Cl. ..... 401/194; 401/75; 401/92

(58) Field of Search ..... 401/194, 68, 75, 401/88, 92

(56) References Cited

U.S. PATENT DOCUMENTS

| | | | | |
|---|---|---|---|---|
| 3,446,563 A | | 5/1969 | Burnham | |
| 3,917,416 A | | 11/1975 | Steyer | |
| 5,183,349 A | * | 2/1993 | Kamen | 401/88 |
| 5,294,205 A | * | 3/1994 | Moeck et al. | 401/70 |
| 5,553,956 A | | 9/1996 | Mitsuya et al. | |
| 5,957,607 A | * | 9/1999 | Tsai | 401/194 |

* cited by examiner

*Primary Examiner*—David J. Walczak
(74) *Attorney, Agent, or Firm*—Bachman & LaPointe, P.C.

(57) ABSTRACT

A crayon comprising a holding portion, a cartridge for receiving a refill of a predetermined color and a cover characterized in that the cartridge is of the color of the refill, and a part of the cartridge is visible from the exterior, more specifically even when the cartridge is held by the holding portion and the cover is fitted on to the cartridge.

5 Claims, 1 Drawing Sheet

CRAYON

BACKGROUND OF THE INVENTION

The invention concerns a crayon comprising a holding portion, a cartridge for receiving a refill of a predetermined color and a cover.

Crayons of the above-indicated kind are known. As it is generally not possible to see the refill when the cover is fitted in place, the known crayons are usually provided with information about the color of the refill. That information is generally printed on the cover or on the holding portion.

Printing information gives rise to problems however in the case of many materials of which by way of example mention may be made here of polypropylene. It is however expressly pointed out that the following discussion relating to polypropylene also applies in regard to other materials which are difficult to print upon.

Polypropylene which is difficult to print upon is particularly suitable for the production of crayons because, by virtue of its hardness, it is possible to produce therefrom for example by way of injection molding particularly light, thin-walled components, and for that reason processing is a particularly simple matter.

Polypropylene can be colored without any problem. It would therefore be possible to envisage making the entire crayon the same color as the refill. Such a structure however is not desired under some circumstances for example for design reasons. Furthermore, stockkeeping in regard to production would involve problems because in fact it would be necessary to stock all parts of the crayon in all the refill colors which occur.

Therefore the object of the invention is to develop the crayon of the kind set forth in the opening part of this specification, in such a way that the production process is simple, more specifically both in regard to processability of the materials used and also in regard to stockkeeping, while nonetheless also including information which is visible from the exterior, about the refill color.

SUMMARY OF THE INVENTION

In accordance with the invention, in a crayon of the kind set forth in the opening part of this specification, that object is attained in that the cartridge is of the color of the refill and a part of the cartridge is visible from the exterior, more specifically even if the cartridge is held by the holding portion and the cover is fitted on to the cartridge.

In that respect the invention is based on the following realisation: In order to have information about the refill color, which is visible from the exterior, it is sufficient for one of the crayon components to be made with the color of the refill. That component must only be visible from the exterior. The cartridge is selected as the correspondingly colored component because it is directly functionally related to the refill. Insofar as just a part of the cartridge is guaranteed to be visible from the exterior, the other components (cover and holding portion) can be of any desired color. They therefore do not have to be stocked separately for each refill color which is involved. In addition, they can be designed or colored to correspond to the respective design demands involved. A printing operation or the like is not required.

In accordance with the invention preferably the cartridge has an annular projection against which the cover bears on the side towards the refill and against which the holding portion bears on the side remote from the refill. That design configuration guarantees that a defined part of the cartridge is visible from the exterior in any condition of operation of the crayon.

In accordance with a particularly preferred embodiment the crayon has a rotary mechanism for axial displacement of the refill within the cartridge by rotating the holding portion and the cartridge relative to each other.

That design configuration affords a particularly simple way of axially displacing the refill (for example for re-adjustment thereof, caused by use thereof).

In that respect, in accordance with a particularly preferred embodiment of the invention, it is provided that the rotary mechanism has a spindle with a male screwthread which in the assembled condition meshes with a female screwthread at the side of the cartridge, that is remote from the refill, wherein the cartridge is held rotatably but axially immovably by the holding portion, the holding portion is in the form of a sleeve and non-rotatably but axially displaceably accommodates the spindle, and the spindle is coupled to the refill admittedly in the axial direction but not in the rotational direction.

That configuration makes it possible for the crayon to be assembled from a total of only five components, namely the holding portion, the cartridge, the spindle, the refill and the cover. Assembly of the crayon is therefore a particularly simple matter.

A further preferred embodiment of the invention provides that the female screwthread of the cartridge is variable in its effective diameter so that it can assume a first position in which it does not mesh with the spindle introduced therein, and a second position in which it meshes with the spindle introduced therein, wherein it is biased in the direction of the first position and is moved into the second position by insertion into the holding portion.

With that design configuration, it is particularly simple to assemble the crayon. More specifically, the spindle can be pushed into the cartridge without a screwing movement being required. More particularly with this design configuration, the spindle is inserted into the cartridge while the cartridge is in the preferred condition due to the biasing thereof, that is to say in that condition in which the female screwthread is of the larger diameter, so that it does not mesh with the male screwthread of the spindle. Then, in a second step, the cartridge with the spindle already disposed therein is fitted into the holding portion, whereby the diameter of the female screwthread on the cartridge is reduced in such a way that it meshes with the male screwthread of the spindle. That step provides that the rotary mechanism is then operable.

In accordance with the invention it can further be provided that a part of the cartridge, that is remote from the refill, is fitted into the holding portion and that force which is required to pull the cartridge out of the holding portion is greater than that force which is required to pull the cover off the cartridge.

This design configuration ensures that, when the holding portion on the one hand and the cover on the other hand are pulled axially apart, the cover is pulled off the cartridge, whereas the cover still remains held by the holding portion.

For that purpose, in accordance with the invention it can be provided that a part of the cartridge, that is remote from the refill, is inserted into the holding portion, wherein provided in the insertion region, on the outside of the cartridge and/or on the inside of the holding portion, is at least one arresting step.

That design configuration is particularly simple to assemble in the production procedure, on the one hand, while on the other hand it is comparatively secure against unintended separation of the cartridge from the holding portion.

In accordance with the invention it is further preferably provided that disposed on the inside of the cover and/or on the outside of the cartridge in a region on to which the cover is fitted is at least one arresting step, the step height of which is less than the step height of an arresting step on the outside of the cartridge and/or on the inside of the holding portion in the insertion region.

That design configuration of the invention is based on the consideration that the height of an arresting step determines that force which is required for axially pulling the said elements apart. The higher the step that is to be overcome, the correspondingly greater is the force required for separation of the components.

Additionally or alternatively it can be provided that the number of arresting steps for holding the cover on the cartridge is greater than the number of arresting steps for holding the cartridge in the holding portion.

That configuration is based on the consideration that a larger number of arresting steps also affords a greater force against the components being pulled apart.

Finally, for reasons already discussed above, it is preferred in accordance with the invention for the holding portion, the cartridge and the cover to comprise polypropylene.

BRIEF DESCRIPTION OF THE DRAWINGS

The invention is described more fully with further details hereinafter by means of preferred embodiments with reference to the accompanying drawing in which.

DETAILED DESCRIPTION OF PREFERRED EMBODIMENTS

Figure 1:
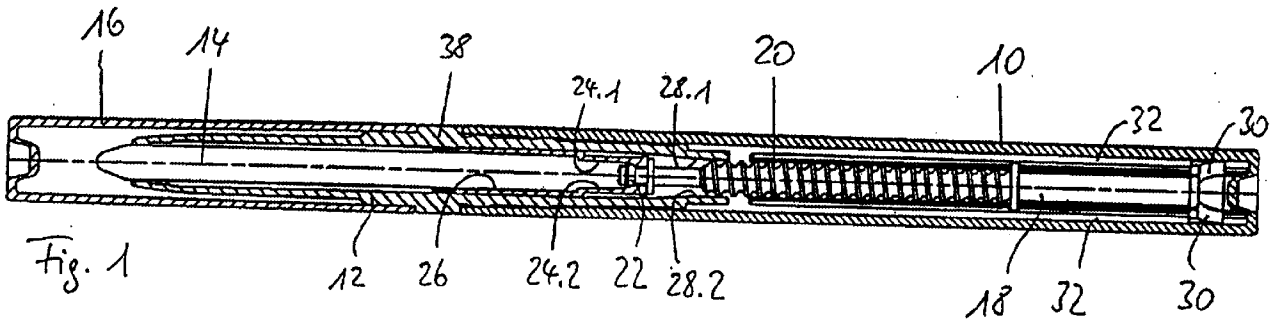
FIG. 1 is a partly sectional view of a preferred embodiment of a crayon according to the invention.
Figure 2:
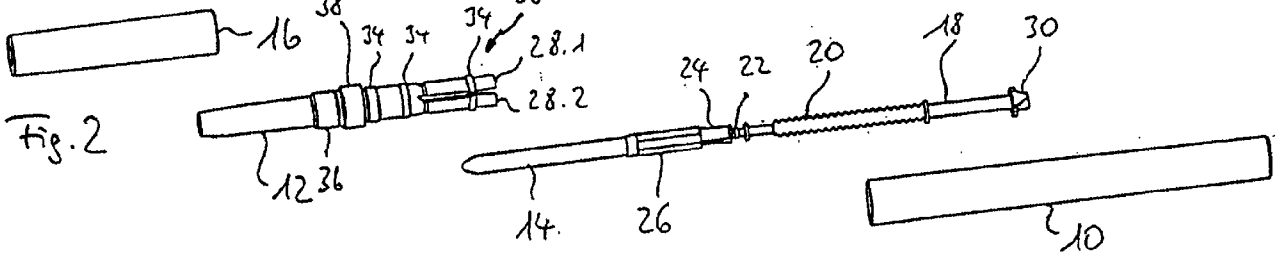
FIG. 2 shows an exploded view of the crayon of FIG. 1.

The crayon shown in FIGS. 1 and 2 includes a sleeve-shaped holding portion 10, a cartridge 12 in which there is disposed a refill 14, and a cover 16. Also shown is a spindle 18 which has a male screwthread 20 and which, at its end towards the cover 16, is held with a mushroomhead-shaped projection 22 in a receiving means 24 in a refill sleeve 26, more specifically being coupled axially immovably to the refill sleeve 26 but being rotatable with respect to the refill sleeve 26. That coupling action is achieved by the receiving means 24 being composed of two half-shell portions 24.1 and 24.2 having steps which engage behind the mushroom-shaped projection 22.

The refill 14 is cast into the refill sleeve 26.

Meshing with the male screwthread 20 on the spindle 18 is a female screwthread 28 on the cartridge 12 which in turn is composed of two half-shell segments 28.1 and 28.2. In the condition shown in FIG. 2, that is to say when the cartridge 12 is not fitted into the holding portion 10, the two segments 28.1 and 28.2 are away from each other to such an extent that their female screwthread does not mesh with the male screwthread 20 of the screwthreaded spindle 18 when the screwthreaded spindle 18 is pushed into the cartridge 12. That permits the screwthreaded spindle 18 to be assembled in the cartridge 12 in a particularly simple manner.

When the screwthreaded spindle 18 has been pushed into the cartridge 12, more specifically to such an extent that the male screwthread on the screwthreaded spindle 18 is in the region of the female screwthread 28, then, by simply pushing that arrangement into the holding portion 10, it can be provided that the female screwthread 28 is reduced in diameter and brought into engagement with the male screwthread 20.

At its end remote from the refill 14 the spindle 18 has projections 30 which bear against webs or bars 32 within the holding portion 10 when the holding portion 10 is rotated with respect to the cartridge 12. In that way the spindle 18 is coupled admittedly non-rotatably but axially displaceably to the holding portion 10.

The holding portion 10 is fitted on to the end of the cartridge, that is remote from the refill. Three arresting projections 34 with corresponding arresting steps on the cartridge 12 serve to prevent axial displacement. They co-operate with arresting projections (not shown) of a corresponding configuration, with corresponding arresting steps, on the inside of the holding portion 10. In that way the holding portion 10 can admittedly be rotated with respect to the cartridge 12, but it is held immovably in the axial direction.

In the same manner, provided on the cartridge 12 is an arresting projection 36 with a corresponding arresting step which serves for correspondingly holding the cover 16.

Although this cannot be readily seen in the drawing, the step heights of the arresting steps for holding the cartridge 12 in the holding portion 10 on the one hand and for holding the cover 16 on the cartridge 12 on the other hand differ, so that, when a user holds the holding portion 10 and pulls on the cover 16, the cover 16 is pulled off the cartridge 12 whereas the cartridge 12 remains in the holding portion 16. That effect is still further promoted by virtue of the fact that a total of three arresting projections 34 are provided on the cartridge 12 for holding the cartridge 12 in the holding portion 10, whereas only a single arresting projection 36 is provided for holding the cover 16 on the cartridge 12.

The cartridge 12 has an annular projection 38. The cover 16 bears against the projection 38 on the side thereof that is towards the refill and the holding portion 10 bears against the projection 38 on the side thereof that is remote from the refill, when the crayon is completely assembled. The projection 38 is thus visible from the exterior in any operating position. In order to give a user information about the color of the refill 14, the invention therefore provides that the cartridge 12 is made with the color of the refill 14 so that the user who can in fact see the projection 38 in any operating position readily obtains information about the color of the refill 14.

The other crayon components, in particular the cover 16 and the holding portion 10 but also the spindle 18 can be of any color. As there is no need of a printing operation to apply the color information, it is also possible for all crayon components to be made from materials which permit particularly simple processing and which are particularly suitable for the crayon with its rotary mechanism. That includes in particular polypropylene, and for that reason, apart from the refill 14, all components of the crayon shown in the drawing are made of polypropylene.

For the sake of completeness, it should be pointed out at this juncture that, in contrast to printing on or stamping on polypropylene parts, coloring does not give rise to any problem.

As—apart from the cartridge—all crayon components can be made of any color, there is no need for separate stockkeeping for each refill color. On the contrary, only the cartridge 12 has to be stocked in all the refill colors involved.

The above-described and illustrated connection of the cover 16 to the cartridge 12 and the rearward encapsulation of the refill 14 by the guidance of the refill sleeve 26 in the cartridge 12 affords sealing integrity which also permits the use of volatile constituents such as isoparaffins and volatile silicone oils in the refill 14.

Figure 3:
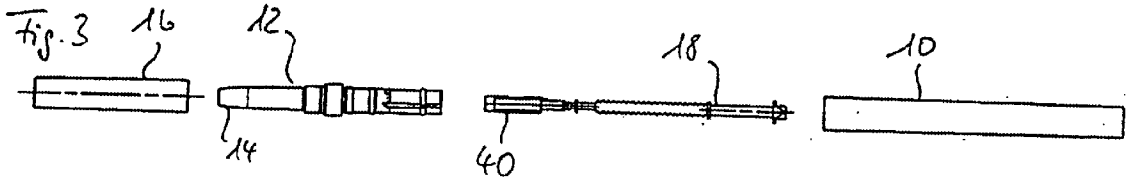
FIG. 3 shows an exploded view of another embodiment of the crayon according to the invention.

The embodiment shown in FIG. 3 corresponds substantially to the embodiment of FIGS. 1 and 2, for which reason the same references will be used.

The only difference is that, instead of the refill sleeve 26, this unit has a plunger 40 and the refill 14 is not cast into the refill sleeve but directly into the cartridge 12. As a result, the spindle 18 is only capable of pushing the refill 14 out of the cartridge 12 by way of the plunger 40, whereas it cannot pull the refill 14 back again. In contrast thereto, in the configuration shown in FIGS. 1 and 2, the spindle 18 can also retract the refill sleeve 26, whereby the refill 14 is also again drawn into the cartridge.

The features disclosed in the foregoing description, the claims and the drawing can be essential, both individually and also in any combinations, for implementing the invention in its various embodiments.

What is claimed is:

1. A crayon comprising:

a holding portion;

a cartridge portion for receiving a refill of predetermined color, the cartridge having a first part received in the holding portion and a second part which receives a cap wherein an annular projection portion, which is of the color of the refill, is located on an outside surface of the cartridge between the first part and the second part, wherein the holding portion, bears on one side of the annular projection and the cap bears on the other side of the annular projection;

a rotary mechanism for axial displacement of the refill within the cartridge by rotation of the holding portion and the cartridge relative to each other, the rotary mechanism comprising a spindle with a male screwthread which meshes with a female screwthread at a side of the cartridge remote from the refill, the female screwthread comprises two half-shell segments each having an inside surface for engaging the male screwthread and an outside surface having an arresting projection which prevents the holding portion from moving axially relative to the cartridge.

2. A crayon according to claim 1, wherein the cartridge is inserted into the holding portion such that a force required to pull the cartridge out of the holding portion is greater than a force which is required to pull the cover off the cartridge.

3. A crayon according to claim 1, wherein at least one of an inside surface of the cap and the second part of the cartridge where the cap is fitted, is provided with at least one arresting projection which is smaller than the arresting projection on the female screwthread.

4. A crayon according to claim 3, wherein the number of the arresting projectionss for holding the cover on the cartridge is smaller than the number of arresting projectionss for holding the cartridge in the holding portion.

5. A crayon according to claim 1, wherein the holding portion, the cartridge and the cover are of polypropylene.

* * * * *